United States Patent [19]

Grüne et al.

[11] Patent Number: 4,867,351

[45] Date of Patent: Sep. 19, 1989

[54] MACHINE FOR FILLING RECEPTACLES WITH FLOWABLE MATERIALS

[75] Inventors: Helmut Grüne; Manfred Nordmeyer, both of Schwarmstedt, Fed. Rep. of Germany

[73] Assignee: Lieder Machinenbau GmbH & Co. KG, Schwarmstedt, Fed. Rep. of Germany

[21] Appl. No.: 38,395

[22] Filed: Apr. 13, 1987

[30] Foreign Application Priority Data

Apr. 19, 1986 [DE] Fed. Rep. of Germany ..... 3613266

[51] Int. Cl.[4] ..... G01I 11/06

[52] U.S. Cl. ..... 222/307; 222/333; 222/368

[58] Field of Search ..... 222/307, 308, 363, 368, 222/333, 148

[56] References Cited

U.S. PATENT DOCUMENTS

| | | | |
|---|---|---|---|
| 845,572 | 2/1907 | Peck | 222/308 |
| 3,140,018 | 7/1964 | Miller | 222/363 |
| 3,335,724 | 8/1967 | Gienapp | 222/333 |
| 4,084,729 | 4/1978 | Epple | 222/307 |

*Primary Examiner*—H. Grant Skaggs
*Attorney, Agent, or Firm*—Peter K. Kontler

[57] ABSTRACT

A machine for transferring metered quantities of flowable materials, such as yoghurt, between a source and successive receptacles on a conveyor has a housing with an inlet in register with the source and an outlet in register with successive empty receptacles on the conveyor, and a metering device which is rotatably mounted in the housing and has an internal chamber as well as an opening which communicates with the chamber and registers with the inlet in a first angular position of the metering device and with the outlet in a second angular position of the metering device. The opening is provided in or close to one end portion of the metering device and the other end portion of the metering device extends from the housing and can be indexed between the first and second positions by a mechanism including a driving unit and a torque transmitting sleeve between the driving unit and the other end portion of the metering device. The sleeve is fastened to the metering device, either directly by way of screws or similar fasteners, or indirectly by way of a tubular insert which surrounds a bearing for the piston rod of a piston reciprocable in the chamber of the metering device to draw flowable material into the chamber in the first position and to expel flowable material from the chamber in the second position of the metering device.

17 Claims, 3 Drawing Sheets

MACHINE FOR FILLING RECEPTACLES WITH FLOWABLE MATERIALS

CROSS-REFERENCE TO RELATED CASE

The machine of the present invention constitutes an improvement of the machine which is disclosed in commonly owned copending patent application Ser. No. 801,796 filed Nov. 26, 1985.

An apparatus which can be used to transport receptacles to be filled with flowable material in the machine of the present invention is disclosed in the commonly owned copending application Ser. No. 767, 410 filed Aug. 20, 1985, now U.S. Pat. No. 4,778,045 granted Oct. 18, 1988.

BACKGROUND OF THE INVENTION

The invention relates to improvements in machines for treating flowable materials, especially viscous materials, and more particularly to improvements in machines for transferring metered quantities of flowable material (such as yoghurt) from a source (e.g., a large vessel) into a succession of smaller receptacles (such as cups or jars).

Presently known machines of the above outlined character comprise a housing with a rotary metering device therein. The internal chamber of the metering device receives a metered quantity of flowable material in a first angular position and discharges the metered quantity in a second angular position with reference to the housing. Such machines operate quite satisfactorily for the admission of metered quantities of cream, yoghurt, other types of milk products and other raw or cooked or otherwise processed foodstuffs of many kinds. The means for indexing the metering device includes a piston rod which has a polygonal outline and is reciprocable in a bearing in the interior of the metering device. The piston rod further serves as a means for reciprocating a piston which is movable in the chamber of the metering device to draw flowable material into the chamber in the first position and to expel flowable material from the chamber in the second position of the metering device. It has been found that the piston rod, which performs the plural functions of reciprocating the piston and of transmitting torque to the metering device, undergoes extensive wear when the machine is in use.

OBJECTS AND SUMMARY OF THE INVENTION

An object of the invention is to provide a machine wherein the part or parts which serve to index the metering device are subjected to less pronounced wear than in conventional machines.

Another object of the invention is to provide the machine with novel and improved means for indexing the metering device.

A further object of the invention is to provide the machine with novel and improved means for transmitting torque from a prime mover to the indexible metering device.

An additional object of the invention is to provide a machine wherein the wear upon the piston rod for the piston which promotes the flow of material into and expulsion of material from the metering device is less pronounced than in conventional machines.

Still another object of the invention is to provide novel and improved means for indexing and for reciprocating the metering device.

A futher object of the invention is to provide a novel and improved method of moving the metering device in a plurality of different directions.

The invention is embodied in a machine for treating a flowable material, such as a viscous foodstuff with randomly distributed solid ingredients. A typical example of flowable material which can be treated in the improved machine is yoghurt with pieces of fruit therein. The machine comprises a suitable source of flowable material, a housing which has an inlet adjacent the source and an outlet, and an elongated rotary metering device which is installed in the housing and has an internal chamber and an opening which communicates with the chamber. The metering device has a first end portion which is provided with or is adjacent the aforementioned opening, and a second end portion which is remote from the inlet and outlet of the housing. The machine further comprises means for indexing the metering device in the housing between a first position in which the opening in or close to the first end portion of the metering device registers with the inlet to receive flowable material from the source and a second position in which the opening registers with the outlet to allow for evacuation of flowable material from the metering device. The indexing means comprises a driving unit and means for transmitting torque from the driving unit to the second end portion of the metering device.

In accordance with a presently preferred embodiment of the indexing means, the torque transmitting means comprises a sleeve which is rigid with the metering device. The driving unit can comprise a gear which is provided on the sleeve and means for rotating the gear. The gear can be shrunk onto the sleeve and the means for rotating the gear can comprise a stepping motor. Such stepping motor can be flange-mounted on the sleeve or it can rotate the sleeve, to index the metering device, through the medium of a pinion on its output shaft.

The sleeve can include a collar which is secured to the second end portion of the metering device by fastener means, e.g., by screws or other types of threaded fasteners. The arrangement is preferably such that the sleeve transmits to the metering device torque at a location which is disposed at or close to the peripheral surface of the second end portion of the metering device.

The means for connecting the sleeve to the second end portion of the metering device can include an insert which constitutes a discrete (preferably tubular) part or is an integral extension of the sleeve, and fastener means for securing the insert to the sleeve and to the second end portion (if the insert is a discrete part) or for securing the insert to the second end portion (if the insert is an integral extension of the sleeve). Such fastener means can comprise threaded fasteners in the form of screws, bolts and nuts or the like.

The machine preferably further comprises a piston which is mounted in the chamber of the metering device and is reciprocable therein to draw flowable material into the chamber by way of the opening in the first position and to expel flowable material from the chamber by way of the opening in the second position of the metering device with reference to the housing. The piston has a piston rod which can have a polygonal or circular cross-sectional outline and has an end portion projecting beyond the second end portion of the metering device, i.e., out of the chamber and into the sleeve or into the insert of the torque transmitting means. A bearing can be installed between the piston rod and the radially inwardly extending collar of the sleeve or between the piston rod and the insert.

The metering device is preferably reciprocable in the housing to allow for more convenient cleaning of its internal and external surfaces, and the machine then further comprises means for reciprocating the metering device with reference to the housing. The reciprocating means can include means for reciprocating the sleeve, for reciprocating the second end portion of the metering device or for reciprocating the aforementioned insert, i.e., for indirectly reciprocating the metering device. To this end, the external surface of the second end portion can be provided with a circumferential groove for a portion of the reciprocating means e.g., for a bifurcated coupling element of the reciprocating means. Alternatively, and as already pointed out above, the means for reciprocating the metering device can be arranged to move the metering device by way of the torque transmitting means of the indexing means. Thus, in lieu of the aforementioned bifurcated coupling element, the means for reciprocating the metering device can comprise a ring which is shrunk onto or is otherwise affixed to and can rotate with the sleeve, and a pusher which is movable in parallelism with the axis of the metering device and can move the sleeve axially by way of the ring. To this end, the ring can extend into a groove or recess of the pusher in such a way that the pusher need not share any angular movements of the ring when the sleeve is indexed with the metering device but that the ring is compelled to share the movements of the pusher in parallelism with the axis of the metering device. The means for moving the pusher can comprise a toothed rack on the pusher and a motor-driven pinion which mates with the rack and is rotatable clockwise as well as counterclockwise.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
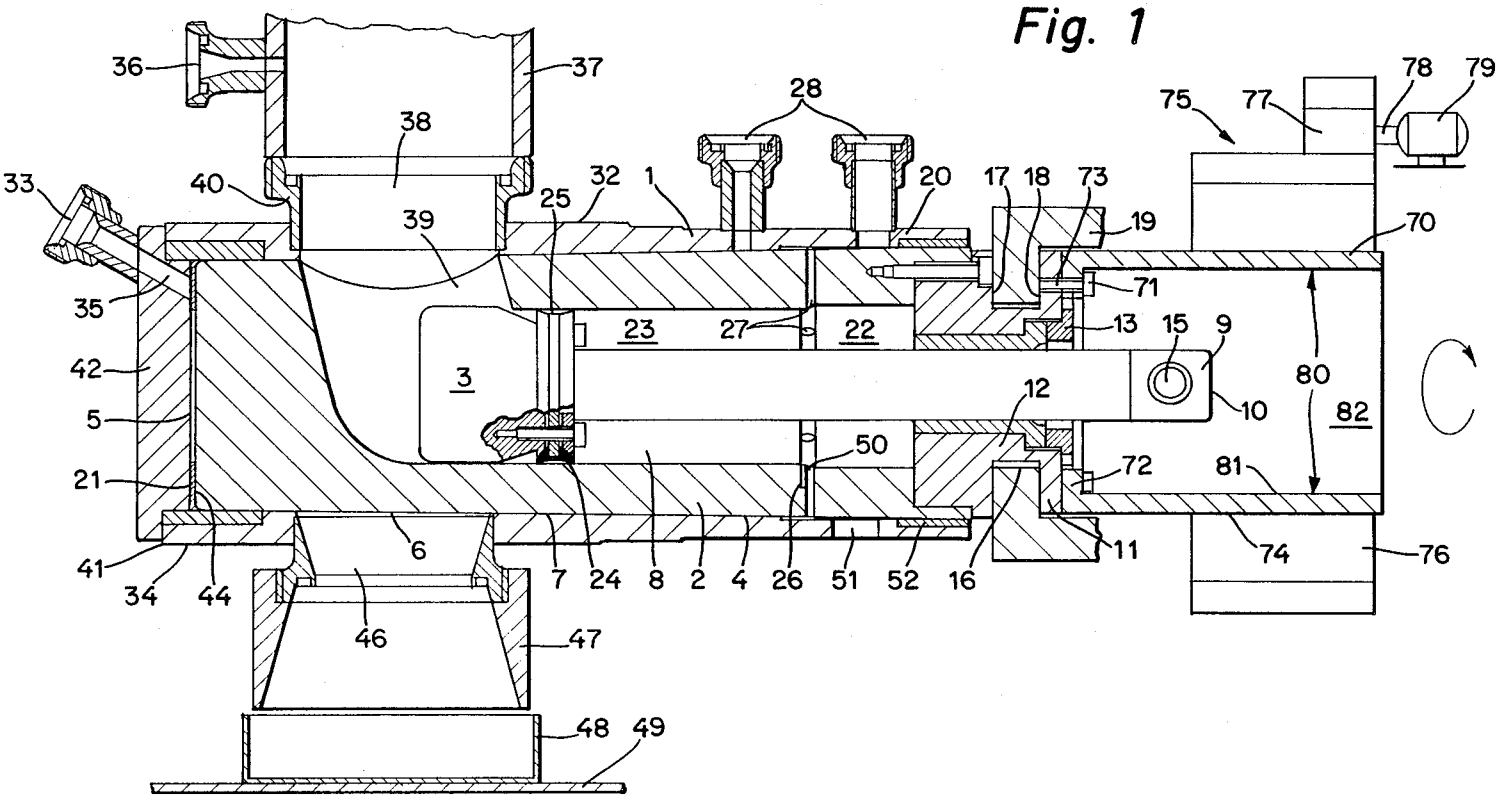
FIG. 1 is a partly elevational and partly longitudinal vertical sectional view of a machine which embodies one form of the invention.

Referring first to FIG. 1, there is shown a machine which serves to transfer metered quantities of a flowable material (e.g., yoghurt with pieces of fruit therein) from a source 37 to successive receptacles 48 (e.g., in the form of cups or jaws) on an intermittently operated endless belt or other suitable conveyer 49. This conveyor may be of the type disclosed in the aforementioned commonly owned copending patent application Ser. No. 767,410.

The improved machine comprises a housing 1 including an elongated tube and a closure or plug 42 at one axial end of the tube. The housing 1 can be said to constitute the body of a rotary slide valve whose valving element or spool is a rotary elongated hollow cylindrical metering device 2 having an axially extending substantially cylindrical internal chamber 8 for a reciprocable piston 3. The metering device 2 is not only rotatable but is also movable axially in the internal space 5 of the housing 1. FIG. 1 shows the metering device 2 in the left-hand end position with minimal or zero clearance 4 between its external surface 6 and the internal surface 7 of the housing 1, and in a first angular position in which an opening 39 at or in one end portion of the metering device communicates with an aperture of an inlet 38 which is provided in the housing 1 and communicates with the source 37. When the metering device 2 is rotated through 180 degrees, it assumes a second angular position in which its opening 39 is in register with an aperture of an outlet 46 forming part of the housing 1 and communicating with a downwardly extending duct or mouthpiece 47 which conveys metered quantities of flowable material from the internal chamber 8 into the adjacent receptacle 48 on the conveyor 49. The metering device 2 is further movable axially of the housing 1 between the first position which is shown in FIG. 1 and in which its frustoconical external surface 6 is immediately adjacent the frustoconical internal surface 7 of the housing 1, and a second position in which the surfaces 6 and 7 define a frustoconical clearance. The internal surface 7 surrounds the space 5 in the housing 1.

The internal chamber 8 of the metering device 2 includes a cylindrical portion 23 one end of which communicates with the opening 39 and the other end of which communicates with an enlarged portion or compartment 22 serving to receive the piston 3 when the latter is held in the right-hand end position, i.e., at a maximum distance from the opening 39.

The means for reciprocating the piston 3 in the metering device 2 between a first position and the (second) position of FIG. 1 comprises a piston rod 9 which has a polygonal or circular outline and is rigidly connected with or forms an integral part of the piston 3 and extends through a centrally located circular or polygonal aperture 13 surrounded by a circular or polygonal internal surface in a bearing rotatable in an end wall 12 which can constitute a detachable (second) end portion of the metering device 2 so that it allows for insertion of the piston 3 into and for its removal from the housing 1.

The rear end portion 10 of the piston rod 9 extends from the housing 1 and metering device 2 and is coupled to a suitable means which serves to reciprocate the piston rod 9, i.e., the piston rod need not transmit torque to the metering device 2. The means for moving the piston rod 9 and hence the piston 3 back and forth to and from the end positions of FIGS. 1 and 2 comprises a transverse pin 15 in a through hole or bore of the end portion 10 of the piston rod. For example, the pin 15 can form part of a fluid-operated double-acting motor means for reciprocating the piston rod 9.

The rear end portion 12 of the metering device 2 confines the bearing for the piston rod 9 and has a circumferentially extending external groove 16 which is flanked by two axially spaced-apart radially extending shoulders 17, 18. The groove 16 receives a preferably collar-shaped coupling element 19 of a means for moving the metering device 2 axially between the position of FIG. 1 and the other position more distant from the front end portion 21 of the housing 1. The coupling element 19 can form part of a fluid-operated motor which can shift the metering device 2 axially when the need arises, i.e., for periodic cleaning of the housing 1, metering device 2 and piston 3. The coupling element 19 can constitute an adapter which connects the metering device 2 with a fluid-operated motor, a rack nd pinion drive or any other suitable means for moving the device 2 axially between the position of FIG. 1 and the other position more distant from the end portion 21. The groove 16 is provided in that end portion 12 of the metering device 2 which extends from the rear end portion 20 of the tube of the housing 1. The diameters of the conical surfaces 6 and 7 decrease in a direction from the rear end portion 20 of the housing 1 toward the inlet 38 and outlet 46, i.e., toward that end portion of the metering device 2 which is provided with or is adjacent the opening 39 and is also adjacent the closure 42 of the housing.

The diameter of the surface surrounding the larger-diameter portion 22 of the chamber 8 defines with the peripheral surface of the piston 3 a rather large clearance when the piston is retracted into the portion 22 by the piston rod 9 preparatory to start of a cleaning operation. The piston 3 comprises a circumferential seal 24 which engages the surface surrounding the cylindrical portion 23 of the chamber 8 while the piston 3 performs predetermined portions of its forward and return strokes, namely while the piston is remote from the enlarged portion or compartment 22. The purpose of the piston 3 is to establish a pressure differential while moving away from the opening 39 (in the first angular position of the metering device 2) so as to draw or suck flowable material from the source 37, through the inlet 38, through the opening 39 and into the cylindrical portion 23 of the chamber 8, as well as to create a pressure differential during its forward movement toward the opening 39 in the second angular position of the metering device 2 so that a metered quantity of such flowable material is forcibly expelled from the cylindrical portion 23 of the chamber 8 via opening 39, outlet 46, duct 47 and into the empty receptacle 48 on the conveyor 49. The external surface 25 of the seal 24 on the piston 3 ensures that the piston can draw metered quantities of flowable material into, and that the piston can expel metered quantities of such material from, the cylindrical portion 23 of the chamber 8 when the machine is in actual use. The clearance between the surface 25 and the internal surface of the metering device 2 is zero but the seal 24 is readily slidable along the internal surface of the metering device in response to axial movement of the piston rod 9 in a direction to the right or to the left, as viewed in FIG. 1.

The reference character 26 denotes a transition zone wherein the inner diameter of the metering device 2 increases gradually or abruptly from that of the surface surrounding the portion 23 to the diameter of the surface surrounding the compartment 22. That portion of the metering device 2 which surrounds the compartment 22 is formed with several radially extending ports 27 forming part of the means for cleaning the housing 1, metering device 2 and piston 3 of the improved machine without necessitating even partial dismantling of the machine, i.e., while the metering device remains in the housing. The means for cleaning further comprises nipples 28 which are permanently connected or which can be connected to a source of compressed gaseous and/or hydraulic cleaning fluid for the components 1, 2 and 3 of the machine. The nipples 28 are or can be threadedly or otherwise connected to a manifold (not shown) having several outlets for admission of pressurized cleaning fluid into the clearance when the metering device 2 is held in the right-hand position, not shown. The manifold is adjacent the external surface 32 of the housing 1. The outlet of the manifold is or can be located substantially midway between the ends of the internal space 5 of the housing 1. The manifold is optional, i.e., the nipples 28 can discharge cleaning fluid directly between the housing 1 and metering device 2 and/or into the chamber 8 of the metering device.

The cleaning device further comprises a third nipple 33 which is installed at the front end 21 of the housing 1 at a level above the major part of an annular portion 34 which forms part of or constitutes the outlet 46. The nipple 33 can admit a cleaning fluid into a port or channel 35 which communicates with the space 5 in the region of the closure 42. A further nipple 36 is provided on the source 37 to admit cleaning fluid into the inlet 38 when the machine is ready for cleaning. Such fluid enters the chamber 8 of the metering device 2 by way of the opening 39 when the metering device is held in the angular position of FIG. 1. The inlet 38 is integral with or forms part of an annular portion 40 of the housing 1 at the latter's front end 21. The source 37 can constitute a tube which has a flange connected to the annular portion 40 of the housing 1.

The front end 21 of the housing 1 is formed with an opening 41 which receives the smaller-diameter portion of the closure 42. A sleeve 44 in the front end portion 21 sealingly engages the adjacent portion of the metering device 2 when the latter assumes the axial position of FIG. 1. The closure 42 has a flange which is outwardly adjacent the sleeve 44 and abuts the adjacent end face of the tube which forms part of the housing 1. The closure 42 is preferably designed to establish a fluid tight seal for the front end 21 of the housing 1.

The closure 42 ensures that the metering device 2 cannot move to the left and beyond the axial position of FIG. 1 when the machine is in actual use, i.e., when the metering device is indexed (either continuously or intermittently) between the two angular positions in one of which the opening 39 can admit flowable material from the source 37 into the cylindrical portion 23 of the chamber 8 and in the other of which such material can be expelled from the chamber 8 to enter the adjacent receptacle 48. A minimal clearance between the surfaces 6 and 7 may be desirable and necessary, even in the axial position of the metering device 2 which is shown in FIG. 1, in order to reduce the likelihood of jamming of the metering device 2 and/or excessive wear upon the surfaces 6 and 7.

The aperture of the inlet 38 of the housing 1 is located diametrically opposite the aperture of the outlet 46. The opening 39 and the apertures of the inlet 38 and outlet 46 may but need not necessarily have a circular shape.

The flange 11 of the annular end portion 12 of the metering device 2 is fixedly connected with a torque transmitting device including an elongated sleeve 70 by means of threaded fasteners 71 which extend through a radially inwardly extending collar 72 at the front end of the sleeve 70 and into tapped bores 73 of the flange 11.

The sleeve 70 extends axially in a direction away from the front end portion 21 of the housing 1 and is rotatable by a driving unit 75 of the means for indexing the metering device 2. In the embodiment which is shown in FIG. 1, the driving unit 75 comprises a ring gear 76 which is affixed to the sleeve 70 and surrounds its external surface 74 and mates with a pinion 77 on the output element 78 of an electric motor 79. The gear 76 can be shrunk onto the external surface 74 of the sleeve 70. The axial length of the gear 76 exceeds the axial length of the pinion 77 (or vice versa) so as to ensure that the pinion remains in mesh with the gear in each axial position of the metering device 2 and sleeve 70.

The sleeve 70 has a large inner diameter 80 and a cylindrical internal surface 81 surrounding a large internal space 82 which receives the rear end portion 10 of the piston rod 9 and the pin 15 as well as the means for reciprocating the pin 15.

The coupling element 19 surrounds the sleeve 70 with a relatively small amount of play. As explained above, the element 19 serves to shift the metering device 2 and the sleeve 70 axially in order to change the width of the gap between the surfaces 6 and 7.

The mode of operation of the machine of FIG. 1 is as follows:

The part 37 of the source of flowable material (such as a milk product with solid particles therein, e.g., yoghurt with pieces of fruit) receives such material from a large vessel, not shown. The material descends through the aperture of the inlet 38 and into the chamber 8 of the metering device 2 by way of the opening 39. The metering device 2 is then kept in the axial position of FIG. 1 in which its opening 39 registers with the aperture of the inlet 38. In order to accelerate entry of a predetermined quantity of flowable material into the metering device 2, the piston 3 is then pulled in a direction to the right through the medium of the pin 15 at the rear end 10 of the piston rod 9 so that the pressure in the interior of the metering device 2 decreases and the space to the left of the piston 3 is filled with flowable material. The piston 3 is brought to a halt before it reaches the cleaning compartment 22.

The electric motor 79 (which can constitute a stepping motor) is then started to index the sleeve 70 and the metering device 2 through 180 degrees (by way of the output element 78, pinion 77 and gear 76) so that the opening 39 registers with the aperture of the outlet 46. The piston 3 is thereupon caused to move back toward the front end portion 21 of the housing 1 so as to promote the transfer of a metered quantity of flowable material from the chamber 8 of the metering device 2 into the receptacle 48 on the conveyor 49 beneath the outlet 46 of the housing 1. The motor 79 is started again as soon as the receptacle 48 is filled so that the metering device 2 is caused to reassume the angular position of FIG. 1 and the opening 39 is again in exact alignment with the aperture of the inlet 38. The piston 3 is then retracted to promote the flow of a metered quantity of flowable material from the part 37 of the source into the metering device 2. The conveyor 49 is set in motion to replace the filled receptacle 48 with an empty receptacle which is properly positioned beneath the outlet 46 not later than when the motor 79 is started again to turn the metering device 2 (with a metered quantity of flowable material in it) so that the opening 39 registers with the aperture of the outlet 46. The same procedure is repeated again and again, as long as necessary.

In order to clean the machine, the coupling element 19 is caused to pull the metering device 2 in a direction to the right. Such movement is shared by the sleeve 70 while the gear 76 remains in mesh with the pinion 77. A relatively short axial movement of the metering device 2 suffices to increase the width of the gap between the surfaces 6 and 7 so as to allow for thorough cleaning and rinsing by a cleaning fluid which is admitted via nipple 33 and channel 35. Additional cleaning fluid is admitted by way of the nipples 28 to flow into the interior of the metering device 2. The cleaning fluid which enters via channel 35 cleans and rinses the interior of the front end portion 21 of the housing 1 and the adjacent parts of the external surface of the metering device 2. Such fluid flows within the sleeve 44 on its way into the gap between the conical surfaces 6, 7 as well as into the internal chamber 8 of the metering device 2 by way of the opening 39. Additional cleaning fluid enters by way of the port 36 to clean the interior of the part 37 of the source of flowable material and to enter the internal chamber 8 by way of the inlet 38 and opening 39. The piston 3 is retracted to such an extent that it is located in the cleaning compartment 22 so that it is washed and rinsed from all sides by cleaning fluid which is admitted via ports 28. The diameter of the compartment 22 is selected with a view to ensure that the surfaces surrounding this chamber are not in contact with the piston 3 when the latter is held in the retracted position to the right of the cylindrical portion 23 of the internal chamber 8 of the metering device 2. The compartment 22 communicates with several radially outwardly extending channels 50 which are machined into or are otherwise formed in the metering device 2 so that spent cleaning fluid can enter a discharge opening 51 in the housing 1. The means for collecting spent cleaning fluid beneath the discharge opening 51 is not shown in the drawing. The cleaning operation can be carried out for a fixed interval of time or for any interval which is necessary to ensure a thorough cleaning and rinsing of the parts 1, 2 and 3. The admission of cleaning fluid to the nipples 28, 33 and 36 is then interrupted and the coupling element 19 is caused to return the metering device 2 to the left-hand end position which is shown in FIG. 1 and in which the gap between the surfaces 6 and 7 is reduced to a minimum value which still allows for turning of the metering device through angles of 180 degrees so as to move the opening 39 into register with the aperture of the inlet 38 or with the aperture of the outlet 46. The machine is then ready to transfer metered quantities of a different flowable material from the part 37 of the source of flowable material into successive receptacles 48 on the conveyor 49.

Figure 2:
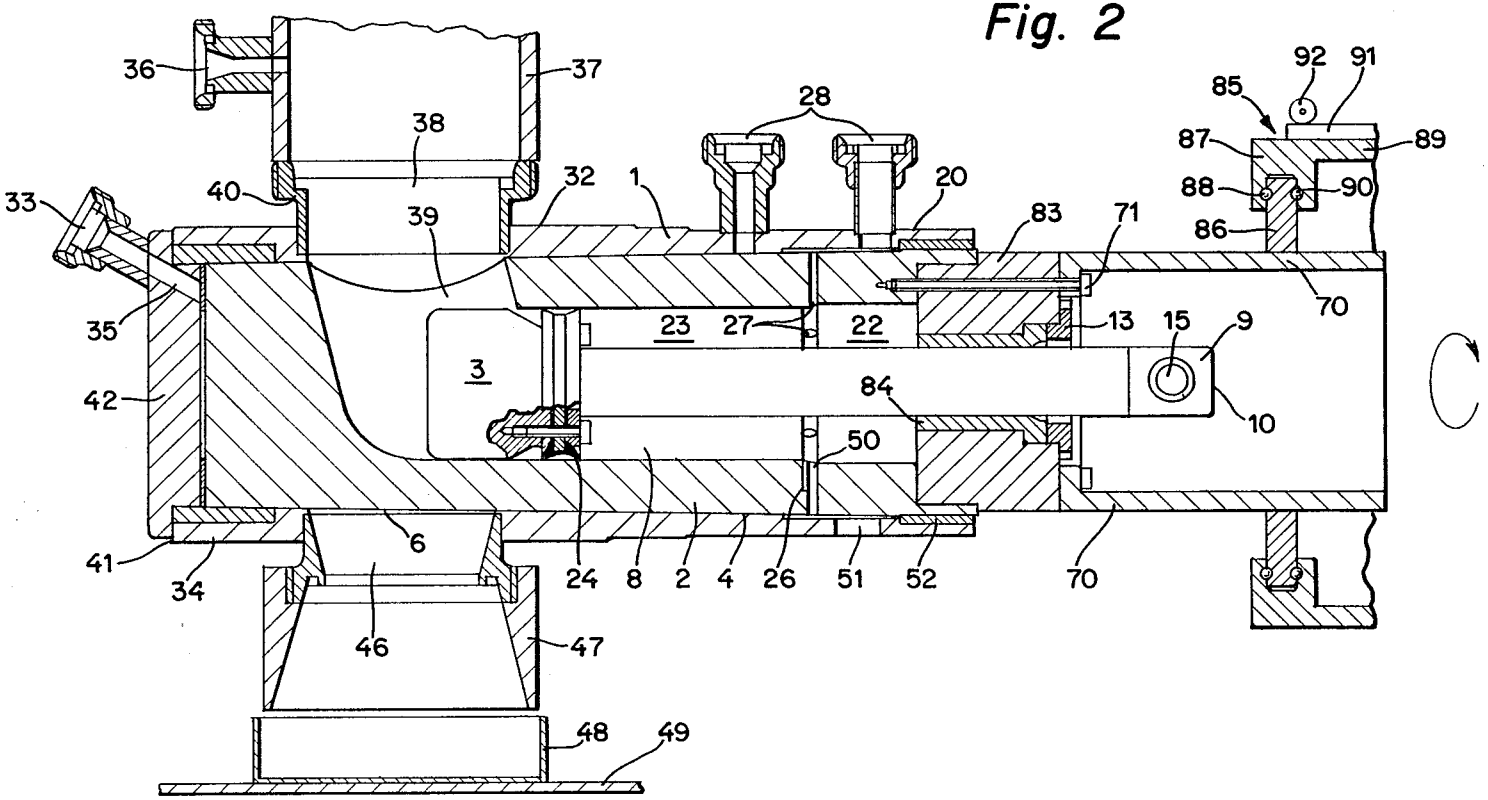
FIG. 2 is a similar view of a second machine wherein the means for transmitting torque to the metering device is constructed in a different way.

FIG. 2 shows a modified apparatus wherein the coupling element 19 is omitted. The torque transmitting sleeve 70 is coupled to the metering device 2 by a tubular intermediate member or insert 83 and serves to index the metering device as well as to move the metering device axially with reference to the housing 1. The connection between the sleeve 70, insert 83 and metering device 2 includes a set of elongated threaded fasteners 71. The purpose of the insert 83 is to confine a sleeve-like bearing 84 which surrounds the piston rod 9. The bearing 84 defines an opening 13 for the piston rod 9.

The means for indexing the sleeve 70 comprises a drive (not shown in FIG. 2) which is identical with or analogous to the driving unit 75 of FIG. 1. In addition, the machine of FIG. 2 comprises a second driving unit 85 which serves to reciprocate the sleeve 70 and the metering device 2. The second driving unit 85 comprises a ring 86 which is fixedly secured to the external surface 74 of the sleeve 70 (e.g., the ring can be shrunk onto the sleeve). A portion of the ring 86 is flanked by a bifurcated pusher 87 which cannot rotate with the ring and is movable in parallelism with the axis of the sleeve 70. Antifriction bearings 88 can be provided on the end faces of the ring 86 to reduce friction while the ring rotates with reference to the pusher 87, i.e., while the stepping motor corresponding to the motor 79 of FIG. 1 is on. Each of the bearings 88 can comprise one or more annuli of rolling elements in the form of spheres or the like. These bearings can be replaced with friction bearings without departing from the spirit of the invention.

The pusher 87 can include a sleeve 89 which surrounds the ring 86 and the sleeve 70. The internal surface of the sleeve 89 has a circumferentially complete groove 90 for the radially outermost portion of the ring 86. The means for moving the pusher 87 in the axial direction of the sleeve 70 comprises a toothed rack 91 which is provided on the sleeve 89 and mates with a pinion 92 driven by a reversible motor, not shown. The driving unit 85 is actuated when the operator wishes to subject the machine to a cleaning operation, i.e., to widen the gap between the surfaces 6 and 7, and when the operator wishes to return the metering device 2 to the operative position of FIG. 2. In all other respects, the machine of FIG. 2 is or can be identical with the machine of FIG . 1. Therefore, the non-described parts of the machine of FIG. 2 are denoted by reference characters which are used in FIG. 1.

Figure 3:
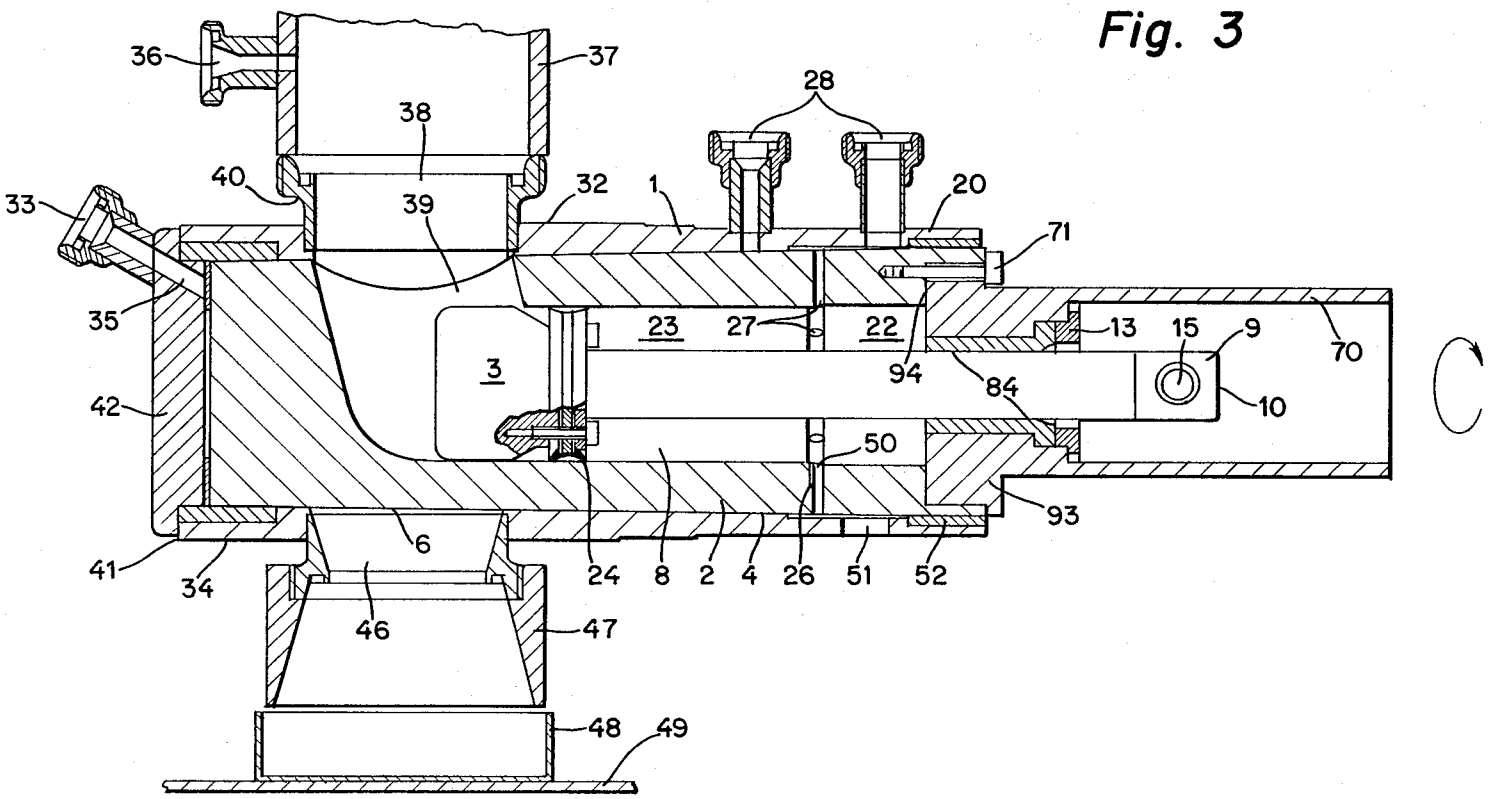
FIG. 3 is a similar view of a third machine which constitutes a modification of the machine shown in FIG. 2.

FIG. 3 shows a modification of the machine of FIG. 2. The sleeve 70 has an extension 93 which is an integral part of this sleeve and is separably but rigidly affixed to the metering device 2 by threaded fasteners 71. The extension 93 is a functional equivalent of the insert 83 of FIG. 2. The front end face of the extension 93 abuts a radially extending shoulder 94 in the rear end portion of the metering device 2. The axial length of the sleeve 70 can be reduced if the manufacturer of the machine desires to reduce the overall length of the machine. In other words, the drives 75 and 85 (not shown in FIG. 3) can be placed into close or immediate proximity of the rear end of the housing 1. The arrangement is preferably such that the connection between the metering device 2 and sleeve 70 is established with a view to ensure that the locus of transmission of torque from the motor 79 to the metering device 2 is located at or close to the periphery of the metering device. This applies for all embodiments of the machine.

As mentioned above, the piston rod 9 can have a circular or a polygonal cross-sectional outline. The utilization of cylindrical piston rod is preferred in many instances because this contributes to a simplification of the bearing for the piston rod (such as the sleeve-like friction bearing 84 shown in FIGS. 2 and 3). A sleeve-like friction bearing 52 is preferably installed between the housing 1 and the metering device 2 to properly center the metering device during indexing as well as during axial movement relative to the housing 1.

An important advantage of the improved machine is that the means for indexing the metering device 2 need not transmit torque to the piston rod 9, i.e., that the metering device need not be indexed by the piston rod. Thus, the piston rod 9 merely serves to reciprocate the piston 3 in the chamber 8 of the metering device 2, and the indexing means including the driving unit 75 and the torque transmitting means including the sleeve 70 serves to intermittently index the metering device in such a way that the transmission of torque need not take place by way of the piston rod 9. Therefore, the wear upon the piston rod 9 and upon the bearings for the piston rod is a fraction of the wear upon the piston rod in a conventional machine. The force with which the indexing means turns the metering device 2 can be selected practically at will because such force need not be taken up and transmitted by the piston rod 9. The machine can employ a relatively weak piston rod since the latter merely serves to reciprocate the piston 3 in the chamber 8 of the metering device 2.

The sleeve 70 of the means for transmitting torque to the second end portion of the metering device 2 constitutes a presently preferred form or part of the torque transmitting means because it is simple, compact and inexpensive and provides room for the means for reciprocating the piston rod 9. In addition, the outer diameter of this sleeve, and the locations of the fastener means 73 which secure the sleeve to the respective end portion of the device 2, can be readily selected in such a way that the location of torque transmission to the metering device is close to the periphery of its end portion. Such mode of connecting the sleeve 70 with the end portion of the device 2 renders it possible to index the metering device in response to the application of a small force. Moreover, the metering device 2 is subjected to less pronounced torsional stresses.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A machine for treating a flowable material, comprising a source of flowable material; a housing having an inlet adjacent said source and an outlet; an elongated rotary metering device reciprocably installed in said housing and having an internal chamber and an opening communicating with said chamber, said device including a first end portion and a second end portion and said opening being provided in the region of said first end potion; means for reciprocating said metering device with reference to said housing, said second end portion of said metering device having an external surface with a circumferentially extending groove and said reciprocating means comprising a coupling element which extends into said groove; and means for indexing said metering device in the housing between a first position in which said opening registers with said inlet to receive flowable material from said source and a second position in which said opening registers with said outlet to allow for evacuation of flowable material from said device, including a driving unit and means for transmitting torque from said unit to the second end portion of said device.

2. The machine of claim 1, wherein said torque transmitting means comprises a sleeve which is rigid with said metering device.

3. The machine of claim 2, wherein said driving unit comprises a gear on said sleeve and means for rotating said gear.

4. The machine of claim 3, wherein said gear is shrunk onto said sleeve.

5. The machine of claim 2, wherein said driving unit includes a stepping motor.

6. The machine of claim 2, wherein said sleeve includes a collar and said torque transmitting means further comprises fastener means for securing said collar to said metering device.

7. The machine of claim 2, wherein said torque transmitting means further comprises threaded fastener means for securing said sleeve to the second end portion of said metering device.

8. The machine of claim 2, wherein said torque transmitting means further comprises means for connecting said sleeve to said metering device including an insert between said sleeve and the second end portion of said device and fastener means for securing said insert to said sleeve and to said second end portion.

9. The machine of claim 8, wherein said fastener means comprises threaded fasteners.

10. The machine of claim 1, further comprising a piston mounted in said chamber and being reciprocable therein to draw flowable material into said chamber by way of said opening in the first position of said metering device and to expel flowable material from the chamber by way of said opening in the second position of said device.

11. The machine of claim 10, wherein said piston includes a piston rod having an end portion extending from said chamber beyond the second end portion of said metering device.

12. The machine of claim 11, wherein said torque transmitting means comprises a sleeve and means for connecting said sleeve to the second end portion of said metering device including an insert interposed between said sleeve and said second end portion and fastener means for securing said insert to said second end portion, said insert spacedly surrounding said end portion of said piston rod and further comprising bearing means disposed in said insert and surrounding said piston rod.

13. The machine of claim 11, wherein said torque tranmitting means comprises a sleeve having a collar spacedly surrounding said end portion of said piston rod and further comprising bearing means interposed between said collar and said piston rod.

14. The machine of claim 1, further comprising a piston which is reciprocable in said chamber and means for moving said piston axially with reference to said metering device to draw flowable material into said chamber in the first position and to expel flowable material from said chamber in the second position of said metering device, said piston having a piston rod which extends from said chamber beyond the second end portion of said metering device and said piston rod having a substantially circular cross-sectional outline.

15. The machine of claim 1, wherein said torque transmitting means comprises a sleeve which is coaxial with said metering device and has an integral extension adjacent the second end portion of said metering device, and means for connecting said extension to said second end portion.

16. A machine for treating a flowable material, comprising a source of flowable material; a housing having an inlet adjacent said source and an outlet; an elongated rotary metering device reciprocably installed in said housing and having an internal chamber and an opening communicating with said chamber, said device including a first end portion and a second end portion and said opening being provided in the region of said first end portion; means for indexing said metering device in the housing between a first position in which said opening registers with said inlet to receive flowable material from said source and a second position in which said opening registers with said outlet to allow for evacuation of flowable material from said device, including a driving unit and means for transmitting torque from said unit to the second end portion of said device, said torque transmitting means comprising a sleeve which is coaxial with said metering device; and means for reciprocating said metering device with reference to said housing by way of said torque transmitting means, said reciprocating means comprising a ring on said sleeve and means for moving said ring axially, said moving means comprising a pusher and said ring being rotatable relative to said pusher, said ring and said pusher comprising means for moving said ring and said sleeve axially in response to movement of said pusher in parallelism with the axis of said metering device.

17. The machine of claim 16, wherein said reciprocating means further comprises means for moving said pusher including a toothed rack on said pusher and a rotatable pinion mating with said rack.

* * * * *